US006774559B2

(12) United States Patent
Kakisaka et al.

(10) Patent No.: US 6,774,559 B2
(45) Date of Patent: Aug. 10, 2004

(54) METAL VAPOR DISCHARGE LAMP

(75) Inventors: Shunsuke Kakisaka, Osaka (JP); Yoshiharu Nishiura, Shiga (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 185 days.

(21) Appl. No.: 09/907,227

(22) Filed: Jul. 17, 2001

(65) Prior Publication Data

US 2002/0021093 A1 Feb. 21, 2002

(30) Foreign Application Priority Data

Aug. 8, 2000 (JP) ..... 2000-239706

(51) Int. Cl.[7] ..... H01J 61/34

(52) U.S. Cl. ..... 313/493; 313/634; 313/239; 313/240; 313/241; 313/242; 313/573

(58) Field of Search ..... 313/110, 493, 313/489, 326, 634, 573, 637, 638, 239, 240, 241, 242

(56) References Cited

U.S. PATENT DOCUMENTS 5,043,623 A * 8/1991 Scholz et al. ..... 313/634
5,424,609 A * 6/1995 Geven et al. ..... 313/634
5,594,294 A * 1/1997 Duffy et al. ..... 313/634

FOREIGN PATENT DOCUMENTS

JP 3-121653 12/1991
JP 4-14356 2/1992

* cited by examiner

*Primary Examiner*—Nimeshkumar D. Patel
*Assistant Examiner*—Sharlene Leurig
(74) *Attorney, Agent, or Firm*—Merchat & Gould P.C.

(57) ABSTRACT

A metal vapor discharge lamp including an outer tube having a closed portion at a first end and a base at a second end; a discharge tube inside of which an electrode is provided, located in the outer tube; and a sleeve enveloping the discharge tube and located in the outer tube, wherein the sleeve includes an open portion on the closed portion side of the outer tube; the closed portion side of the outer tube is provided with a support for supporting an end of the closed portion side of the sleeve; the support comprises a column portion having a narrow plate shape or a narrow stick shape separated from the open portion of the closed portion side of the sleeve, and a sleeve holding portion provided at an end of the column portion and is in contact with the sleeve; and the support is connected to a feeding body connected to the electrode and led from the discharge tube toward the side of the closed portion, and the support also is connected to an electric power supply wire extending toward the side of the base. Thereby, it is possible to provide a high efficiency and long lifetime metal vapor discharge lamp capable of suppressing abnormal noises after the lamp is turned on or off with the sleeve supported firmly.

18 Claims, 6 Drawing Sheets

METAL VAPOR DISCHARGE LAMP

FIELED OF THE INVENTION

The present invention relates to a metal vapor discharge lamp.

BACKGROUND OF THE INVENTION

As a conventional metal vapor discharge lamp, for example, a metal halide lamp, a lamp having a configuration in which a discharge tube is enveloped by a glass cylindrical sleeve (hereinafter, "sleeve" will be referred to) in order to prevent an outer tube from being damaged due to the rupture of the discharge tube at the end of the lifetime, with both ends of the sleeve being closed by a metal plate is proposed (JP2 (1990)-230655 A).

This metal plate is provided with a tongue piece that is brought into contact with the outer tube and the sleeve respectively. By bringing the tongue piece into contact with the inner surface of the outer tube, the sleeve is allowed to be held in the predetermined portion in the outer tube.

Furthermore, in recent years, such a conventional metal halide lamp uses a translucent ceramic discharge tube that is excellent in thermal resistance or halogen resistance. A conventional metal halide lamp using this translucent ceramic discharge tube includes a light-emitting portion and thin tube portions. Inside the light-emitting portion, an electrode is disposed in which a metal halide (a light-emitting metal) and the like is filled. The thin tube portions are provided at both ends of the light emitting portion and include a feeding body made of a conductive cermet, niobium, or the like sealed with a sealing material.

However, in such a conventional metal halide lamp, when the lamp is turned on, heat radiated from the discharge tube remains in a space formed by the sleeve and the metal plate. In particular, in a metal halide lamp using a translucent ceramic discharge tube, due to the difference in the coefficient of thermal expansion between the thin tube portion and the sealing material and between the feeding body and the sealing material, cracks tend to occur in the sealed portions. Furthermore, a reaction between the metal halide and the sealing material is promoted, thus deteriorating the sealing material, which may cause the leakage in the discharge tube. Consequently, the lifetime of lamp is shortened.

Moreover, the sealing portion herein denotes a sealing material and a portion of the thin tube portion sealed with the sealing material.

Furthermore, since both ends of the sleeve are closed with the metal plate, light traveling toward the direction of the closed portion side of the outer tube is shielded by the metal plate, thus deteriorating the light flux.

Furthermore, since the outer tube is in contact with the tongue piece of the metal plate positioned on the closed portion side of the outer tube, after the lamp is turned on or off, when the discharge tube is thermally-expanded or thermally-shrunk, the metal plate moves following the thermal expansion or thermal shrinkage, and at this time, the tongue piece rubs against the inner surface of the outer tube, thus to make an abnormal noise.

SUMMARY OF THE INVENTION

With the foregoing in mind, it is an object of the present invention to provide a highly efficient and long lifetime metal vapor discharge lamp capable of suppressing the occurrence of abnormal noises after the lamp is turned on or off with a sleeve supported firmly.

In order to achieve the above-mentioned object, the metal vapor discharge lamp according to the present invention includes an outer tube having a closed portion at a first end and a base at a second end; a discharge tube inside of which an electrode is provided, located in the outer tube; and a sleeve enveloping the discharge tube and located in the outer tube, wherein the sleeve includes an open portion on the closed portion side of the outer tube; the closed portion side of the outer tube is provided with a support for supporting an end of the closed portion side of the sleeve; the support includes a column portion having a narrow plate shape or a narrow stick shape separated from the open portion of the closed portion side of the sleeve, and a sleeve holding portion provided at an end of the column portion and is in contact with the sleeve; and the support is connected to a feeding body connected to the electrode and led from the discharge tube toward the side of the closed portion, and connected to an electric power supply wire extending toward the side of the base.

According to this configuration, since the amount of light flux emitted from the sleeve can be increased with the sleeve supported firmly, and the sleeve can be opened to the greatest extent practicable, it is possible to prevent heat from building up in a space enveloped by the sleeve. Furthermore, since the lamp of the present invention does not use the tongue piece unlike the conventional lamp, it is possible to suppress the occurrence of abnormal noises after the lamp is turned on or off.

DETAILED DESCRIPTION OF THE INVENTION

Figure 1:
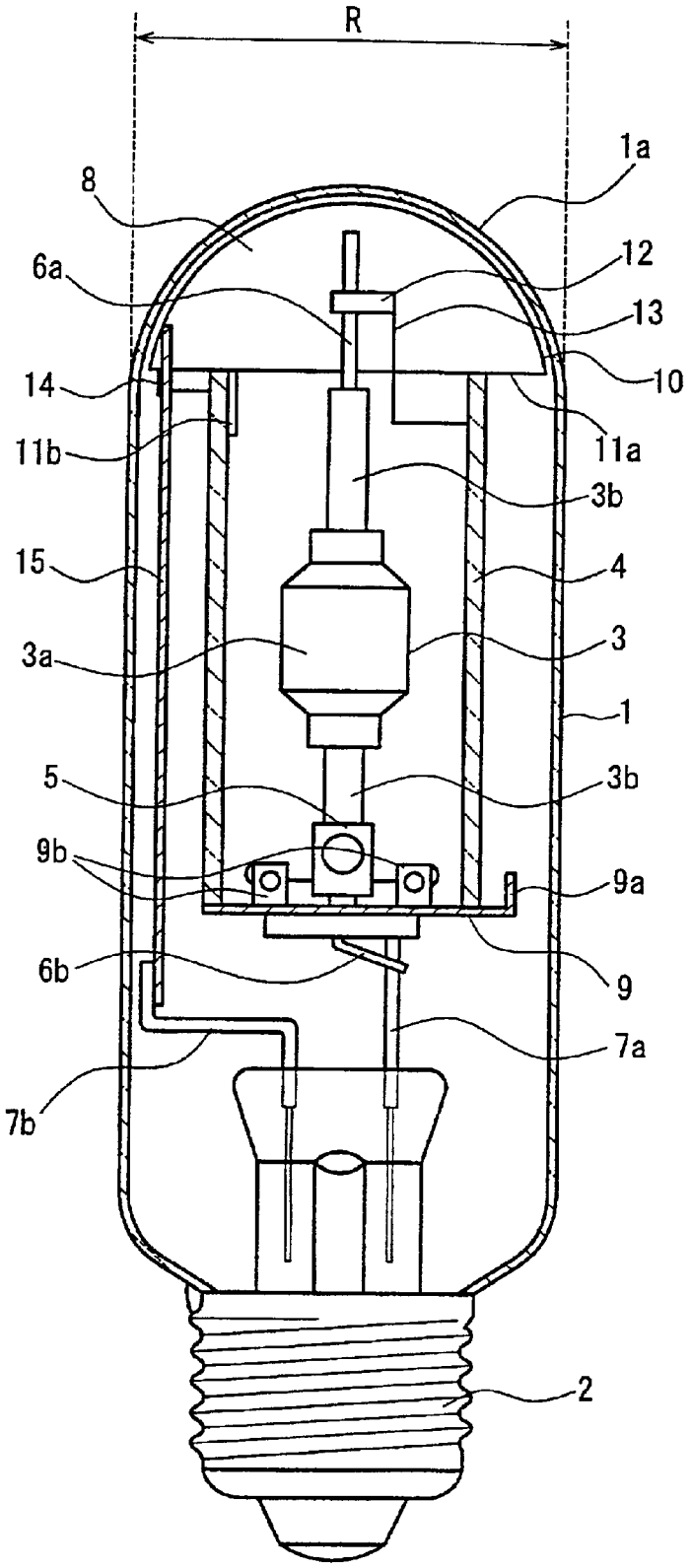
FIG. 1 is a partially cutaway view of a metal halide lamp according to a first embodiment of the present invention.

In the present invention, it is preferable that the column portion is provided in the vicinity of the closed portion of the outer tube. Specifically, it is preferable that a distance between the outer tube and the closed portion is maintained at 3 mm or less.

Furthermore, it is preferable that the column portion has a shape along the internal shape of the closed portion of the outer tube.

Furthermore, it is preferable that the column portion and the sleeve holding portion are formed of one continuous member.

Furthermore, it is preferable that the following relationship is satisfied:

$$0.05R \leqq W \leqq 0.25R$$

wherein W (mm) denotes a width of the column portion having the narrow plate shape and R (mm) denotes a maximum outer diameter of the outer tube.

Furthermore, it is preferable that the support is provided with a protruding portion that is provided in the vicinity of the closed portion of the outer tube and protrudes from the column portion.

Furthermore, it is preferable that the sleeve holding portion has an L-shaped cross section.

Furthermore, it is preferable that the sleeve holding portion is provided with concave grooves into which the end of the sleeve is fitted.

Furthermore, it is preferable that an elastic body is disposed between the sleeve holding portion and the feeding body.

Furthermore, it is preferable that the sleeve holding portion is provided with a convex portion that is brought into point-contact with the sleeve.

Furthermore, it is preferable that the feeding body, which is led from the discharge tube toward the side of the closed portion, extends to the closed portion and is sandwiched between the outer tube and the column portion of the support.

Furthermore, it is preferable that the outer tube is filled with an inert gas. In particular it is preferable that the inert gas is filled to a pressure of $1.33\times10^4$ Pa or more.

Furthermore, it is preferable that the discharge tube and the sleeve are arranged so that each of the central axis of the discharge tube and the central axis of the sleeve substantially corresponds to the central axis of the outer tube.

Furthermore, it is preferable that the discharge tube includes a light-emitting portion in which an electrode is provided and a light-emitting metal and a rare gas are filled inside; and a thin tube portion which is provided at both ends of the discharge tube and in which a feeding body connected to the electrode is sealed with a sealing material inside the thin tube.

Furthermore, it is preferable that the light-emitting metal is a metal halide.

Furthermore, it is preferable that the feeding body is a conductive cermet obtained by sintering a mixture of molybdenum and alumina, or a metal body selected from the group consisting of niobium and molybdenum.

Furthermore, it is preferable that an end led from the discharge tube of one of the feeding bodies is connected to the support by welding.

Furthermore, it is preferable that an end led from the discharge tube of another of the feeding bodies is connected to the base via a metal wire.

The following is an explanation of preferred embodiments of the present invention with reference to the accompanying drawings.

First Embodiment

As shown in FIG. 1, a metal halide lamp having a rated power of 150 W according to the first embodiment of the present invention includes a translucent ceramic (for example, alumina ceramic, etc.) discharge tube 3 and a cylindrical quartz glass sleeve 4 enveloping substantially the entire part of the discharge tube 3 inside a hard glass outer tube 1 having a length of 125 mm and a maximum outer diameter of 40 mm. The outer tube 1 has a hemispherical shaped closed portion 1*a* placed at one end and a base 2 (for example, E26 type base) attached to another end. The discharge tube has a length of 49 mm (excluding protruding portions of the feeding bodies 6*a* and 6*b*) and a maximum outer diameter of 12 mm. The sleeve 4 has a length of 58 mm, an outer diameter of 25 mm and an inner diameter of 22 mm.

In FIG. 1, reference numeral 5 denotes a getter.

The outer tube 1 is filled with an inert gas such as nitrogen etc. to a pressure of $1.33\times10^4$ Pa (100 Torr) or more. Thereby, the inert gas moves by convection inside the outer tube 1, making it possible to prevent the discharge tube 3 from being heated excessively. Thus, the vapor pressure of a light-emitting metal filled in the discharge tube 3 can be maintained properly.

The discharge tube 3 and the sleeve 4 are arranged so that each of the central axes of the discharge tube 3 and the sleeve 4 substantially corresponds to the central axis of the outer tube 1.

The discharge tube 3 includes a light emitting portion 3*a* in which an electrode (not shown in figure) is provided and a light-emitting metal and a rare gas are filled in a predetermined amount inside; and a thin tube portion 3*b* which is provided on both ends of the discharge tube 3*a* and in which feeding bodies 6*a* and 6*b* connected to the electrode are sealed with a sealing material (not shown in figure) inside.

As the light-emitting metal, a metal halide such as sodium iodide, scandium iodide, or the like can be used.

As the feeding bodies 6*a* and 6*b*, a conductive cermet obtained by sintering the mixture of molybdenum and alumina, or a metal such as niobium, molybdenum, or the like are used. In an example shown in FIG. 1, the feeding body 6*a* and 6*b*, made of niobium and having a length of 23 mm and a diameter of 0.92 mm are used. The end led from the discharge tube 3 of one feeding body 6*a* is connected to a below mentioned support 8 by resistance welding, etc. Furthermore, the end led from the discharge tube 3 of another feeding body 6*b* is connected to the base 2 via a stem wire 7*a* made of a nickel plated steel wire.

The sleeve 4 has open portions at both end thereof. The open portions are positioned on the closed portion 1*a* side and the base 2 side of the outer tube respectively. The end of the sleeve 4 positioned on the closed portion 1*a* side is supported by the support 8, and another end of the sleeve 4 positioned on the base 2 side is supported by the metal plate 9, respectively. In other words, the sleeve 4 is sandwiched between the support 8 and the metal plate 9, and thereby supported.

Figure 2:
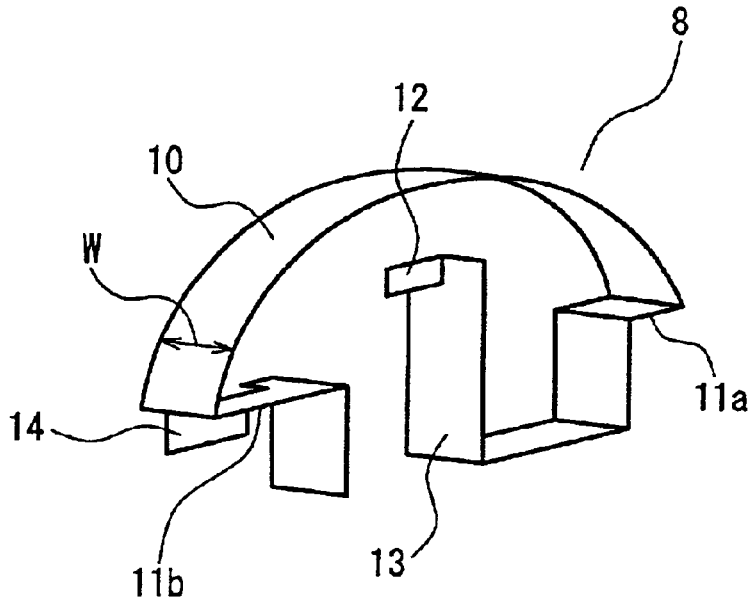
FIG. 2 is a perspective view showing a support used for the metal halide lamp.

As shown in FIGS. 1 and 2, the support 8 is separated from the open portion of the sleeve 4 that is positioned on the closed portion 1*a* side of the outer tube 1. And the support 8 includes a column portion 10 having the narrow plate shape that is provided in the vicinity of the a closed portion 1*a*; sleeve holding portions 11*a* and 11*b* positioned at both ends of the column portion 10 and being in contact with the sleeve 4; a feeding body connection portion 12 to which the feeding body 6*a* is connected; an elastic body 13 disposed between one sleeve holding portion 11*a* and the feeding body connection portion 12; and a power supply wire connection portion 14 to which a below mentioned power supply wire 15 is connected. These portions, that is, the column portion 10, the sleeve holding portions 11*a* and 11*b*, the feeding body connection portion 12, the elastic body 13 and the power supply wire connection portion 14 may be formed of one continuous member, that is, one stainless steel plate having a length of 99 mm and a thickness of 0.2 mm. Since these portions of the support 8 are formed of one continuous member, it is possible to produce and process the support 8 easily, thus enabling the productivity of lamps to be improved.

Moreover, besides stainless steel, as the material for the support 8, iron, molybdenum, or the like may be used.

The column portion 10 is provided in the vicinity of the closed portion l*a* and has a half arc shaped cross section along the inner shape of the closed portion 1*a*.

Furthermore, in order to obtain a sufficient mechanical strength of the support 8 and to prevent the deterioration of light flux, it is preferable that the following relationship is satisfied:

$$0.05R \leqq W \leqq 0.25R$$

wherein the width W (mm) denotes the column portion 10 and the maximum outer diameter R (mm) denotes the outer tube. If the width W of the column portion 10 is less than 0.05R, the support 8 cannot have a sufficient mechanical strength and it may be difficult to support the sleeve 4. On the other hand, if the width W of the column portion 10 is more than 0.25R, the column portion 10 is shaded and the light flux may be deteriorated. In an example shown in FIGS. 1 and 2, the width of the column portion 10 is 5 mm.

One sleeve holding portion 11*a* has an L-shaped cross section. Namely, a portion that is in contact with the end face of the sleeve 4 (length: 7 mm, width: 5 mm) is connected substantially perpendicular to a portion that is in contact with the inner face of the sleeve 4 (length: 5 mm, width: 5 mm).

Another sleeve holding portion 11*b*, similar to the sleeve holding portions 11*a*, has an L-shaped cross section. A portion that is in contact with the end face of the sleeve 4 (length: 7 mm, width: 5 mm) is connected substantially perpendicular to a portion that is in contact with the inner face of the sleeve 4 (length: 7 mm, width: 5 mm).

Since each of the sleeve holding portions 11*a* and 11*b* has an L-shaped cross section, it is possible to press the sleeve 4 to the base 2 side in a portion where each sleeve of the holding portions 11*a* and 11*b* is in contact with the sleeve 4 respectively, thus preventing the sleeve 4 from moving toward the closed portion 1*a* side of the outer tube 1. Furthermore, a portion where one sleeve holding portion 11*a* is in contact with the inner surface of the sleeve 4 and a portion where another sleeve holding portion 11*b* is in contact with the inner surface of the sleeve 4 can be pressed onto the sleeve 4 in a manner in which both portions are pressed in the opposite directions respectively in the direction outward and perpendicular with respect to the central axis of the sleeve 4. Thereby, it is possible to press the sleeve so as to prevent the sleeve 4 from moving in the direction perpendicular with respect to the central axis of the sleeve 4.

The feeding body connection portion 12 is provided at the tip of the elastic body 13 and is formed of a plate (size: 2 mm×6 mm) that may be substantially provided perpendicular to the tip portion of the elastic body 13.

The elastic body 13 has an L-shaped cross section in which a portion having a length of 11 mm and a width of 5 mm is connected perpendicularly to a portion having a length of 6 mm and a width of 5 mm. One end is connected to one end of the sleeve holding portion 11*a*. The cross sectional shape of this elastic body 13 is elastically deformed from L-shape to a shape like "<" when the discharge tube 3 is thermal-expanded or thermal-shrunk after the lamp is turned on or off. With the thermal expansion or thermal shrinkage of the discharge tube 3, stress generated particularly in the thin tube portion 3*b* can be absorbed, thus preventing the thin tube portion 3*b* from being broken.

The power supply wire connection portion 14 is formed by folding at a substantially right angle a part of the sleeve holding portion 11*b* which is in contact with the end face of the sleeve 4 to the discharge tube 3 side. The power supply wire connection portion 14 is connected to the power supply wire 15 extending toward the base 2 by resistance welding and the like.

The power supply wire 15 is connected to the base 2 via a stem wire 7*b* made of molybdenum.

The metal plate 9 for supporting the sleeve 4 may have a disk-like shape having a diameter of 34 mm and a thickness of 0.2 mm. On the outer circumference of the metal plate 9, there are provided a plurality of outer tongue pieces 9*a* (only one tongue piece is shown in FIG. 1) in close vicinity to the inner surface of the outer tube 1 and a plurality of inner tongue pieces 9*b* that are pressed into contact with the inner face of the sleeve 4.

The outer tongue piece 9*a* prevents the sleeve 4 from being damaged by crashing into the outer tube 1 due to the vibration or shock, etc. during the transportation. Furthermore, the inner tongue piece 9*b* prevents the sleeve 4 from moving in the direction perpendicular to the central axis of the sleeve 4.

Furthermore, it is preferable that the metal plate 9 is provided with a ventilation hole (not shown) for efficiently communicating the inert gas between the outer tube 1 and the sleeve 4.

Moreover, the discharge tube 3 is not connected directly to the metal plate 9. Therefore, even if the discharge tube 3 is thermal-expanded or thermal-shrunk after the lamp is turned on or off, the metal plate 9 does not move following the thermal expansion or thermal shrinkage of the discharge tube 3.

Next, the characteristics of a metal halide lamp according to the first embodiment of the present invention (hereinafter, "the lamp of the present invention" will be referred to) were evaluated.

First, ten lamps of the present invention were prepared, and the lamp efficiency (1 m/W) and the occurrence of leaks in the discharge tube 3 were examined.

Furthermore, for comparison, a metal halide lamp with a rated power of 150 W (hereinafter, "the lamp of the comparative example" will be referred to) was prepared in the same manner as in the first embodiment of the present invention except that the both ends of the sleeve 4 were closed by the metal plates 9 (namely, the metal plate 9 was provided also on the closed portion 1*a* side of the outer tube 1). Also for the compared product, the lamp efficiency and the occurrence of leaks in the discharge tube 3 were examined under the same conditions.

The lamp efficiency was examined after 100 hours use.

As a result, the lamp of the present invention had the lamp efficiency of 931 m/W. On the other hand, the lamp of the comparative example had the lamp efficiency of 901 m/W. The reason why such results were obtained is thought to be as follow. The lamp of the present invention used the support 8 as a member for supporting the sleeve 4, in particular, the closed portion 1*a* side of the outer tube 1. Consequently, the light toward the closed portion 1*a* of the outer tube 1 is not shielded and the amount of the light flux emitted from the sleeve 4 can be increased as compared with the lamp in which the both ends of the sleeve 4 are closed by using the metal plate 9 like the lamp of the comparative example. Therefore, it could be confirmed that the lamp of the present invention had a higher efficiency than the lamp of the comparative example.

Furthermore, in the lamp of the present invention, no occurrence of leaks was observed in the discharge tube 3. On the other hand, in the lamps of the comparative example, leaks occurred in the discharge tube 3 in three out of ten lamps. The reason why such results were obtained is as follows. Since in the lamp of the present invention, an open portion of the sleeve 4 positioned on the closed portion 1*a* side of the outer tube 1 was opened to the greatest extent practicable, heat radiated from the discharge tube 3 did not remain inside the sleeve. Therefore, since the temperature of the discharge tube 3 was not raised excessively, it was possible to suppress the stress to the sealing portion, which is generated due to the difference in the coefficient of thermal expansion between the thin tube portion 3*b* and the sealing material, and between the feeding body 6*a* and the sealing material. Furthermore, it was possible to prevent cracks from occurring in the sealing material, as well as to prevent the light-emitting metal disposed in the gap between the thin tube portion 3*b* and the feeding body 6*a* from reacting with the sealing material. Furthermore, it could be confirmed that the lifetime of the lamp of the present invention is longer than that of the lamp of the comparative example.

Next, for the lamps of the present invention and the lamps of the comparative example, the occurrence of abnormal noises after the lamp is turned on or off was examined.

As a result, in the lamps of the present invention, after the lamp is turned on or off, abnormal noises of 30 dB or more did not occur. On the other hand, in the lamp of the comparative example, after the lamp is on, abnormal noises of 30 dB or more occurred twice or more. The reason why such results were obtained is thought to be as follow. In the lamp of the present invention, unlike the lamp of the comparative example, the lamp of the present invention has no member such as a tongue piece that rubs against the outer tube 1. Furthermore, in the lamp of the present invention, even if the column portion 10 is in contact with the outer tube 1, when the discharge tube 3 is thermal-expanded or thermal-shrunk, the column portion 10 is only pressed onto the closed portion side of the outer tube 1 but does not rub against the outer tube 1. Therefore, it could be confirmed that in the lamp of the present invention, the occurrence of the abnormal noises after the lamp was turned on or off, could be suppressed as compared with the comparative example.

According to the configuration of the first embodiment of the present invention mentioned above, it is possible to suppress the occurrence of abnormal noises after the lamp is turned on or off with the sleeve 4 supported firmly. Furthermore, high efficiency and long lifetime of the lamp can be realized.

Furthermore, in particular, since the column portion 10 of the support 8 is provided in the vicinity of the closed portion 1*a* of the outer tube 1, it is possible to prevent the sleeve 4 from moving due to the vibration or shock, etc. during the transportation. Furthermore, it is possible to prevent the sleeve 4 from being damaged by crashing into the outer tube 1. In other words, it is possible to improve the vibration resistance. It is preferable that the minimum distance between the outer tube 1 and the column portion 10 is set to be in the range from 0 mm to 3 mm for obtaining the sufficient vibration resistance.

Furthermore, in particular, when the column portion 10 of the support 8 is provided in the vicinity of the closed portion 1*a* of the outer tube 1, since the column portion 10 has a shape along the inner shape of the closed portion l*a*, it is possible to suppress the movement of the sleeve 4 to a minimum, thus enabling the vibration resistance to be improved further.

Second Embodiment

Figure 3:
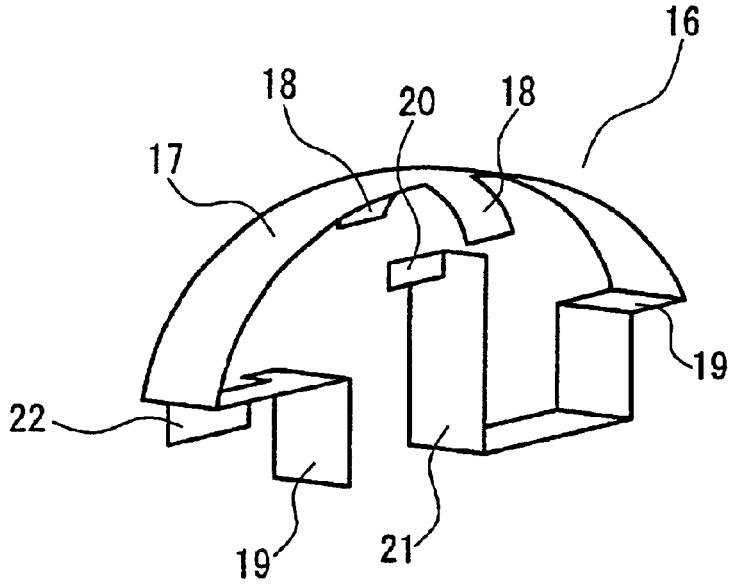
FIG. 3 is a perspective view showing a support used for a metal halide lamp according to a second embodiment of the present invention.

Next, as shown in FIG. 3, the metal halide lamp having a rated power of 150 W according to the second embodiment of the present invention has the same configuration as in the metal halide lamp having a rated power of 150 W according to the first embodiment except that the support 16 is provided with a protruding portion 18 that is provided in the vicinity of the closed portion 1*a* of the outer tube 1 and protrudes from the column portion 17.

The protruding portion 18 is a plate having a length of 10 mm and a width of 5 mm and provided in the center of the column portion 17. The protruding portion 18 protrudes substantially perpendicular to the column portion 17. In other words, the column portion 17 and the protruding portion 18 forms a cross shape. Furthermore, the column portion 17 and the protruding portion 18 may be formed of one plate.

Moreover, in FIG. 3, reference numeral 19 denotes a sleeve holding portion; 20 denotes a feeding body connection portion; 21 denotes an elastic body and 22 denotes a power supply wire connection portion, respectively.

According to the configuration of the second embodiment of the present invention mentioned above, it is possible to suppress the occurrence of abnormal noises when the lamp is turned on or off, with the sleeve 4 supported firmly, and to realize the high efficiency and the long lifetime of lamp. In addition, it is possible to prevent the sleeve 4 from moving in the direction perpendicular to the longitudinal direction of the column portion 17, thus enabling the vibration resistance to be improved further.

Third Embodiment

Figure 4:
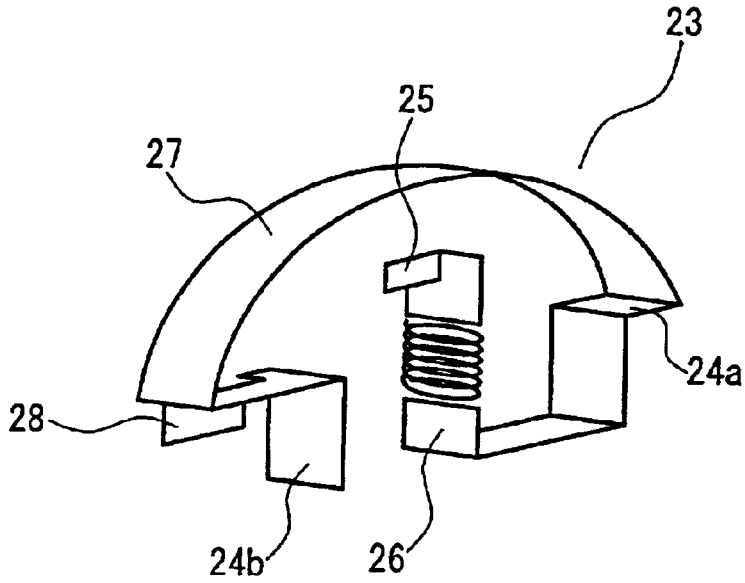
FIG. 4 is a perspective view showing a support used for a metal halide lamp according to a third embodiment of the present invention.

Next, as shown in FIG. 4, the metal halide lamp having a rated power of 150 W according to the third embodiment of the present invention has the same configuration as in the metal halide lamp having a rated power of 150 W according to the first embodiment except that an elastic body 26 formed of an expandable helical spring is disposed between a sleeve holding portion 24*a* and a feeding body connection portion 25 in a support 23.

The elastic body 26 may include molybdenum and has a length of 5 mm and the diameter of 5 mm.

In FIG. 4, reference numeral 24*b* denotes another sleeve holding portion; 27 denotes a column portion; and 28 denotes a power supply wire connection portion, respectively.

According to the configuration of the third embodiment of the present invention mentioned above, it is possible to suppress the occurrence of abnormal noises after the lamp is tuned on or off with the sleeve supported firmly, and to realize the high efficiency and the long lifetime of lamp. In addition, it is possible to absorb a stress generated in the thin tube portion 3*b* due to the thermal expansion or thermal shrinkage of the discharge tube 3, thus preventing thin tube portion 3*b* from being damaged.

In the third embodiment mentioned above, the elastic body 26 formed of a helical spring was explained. The configuration of the elastic body 26 is not limited to this alone and other expandable elastic materials such as a plate spring, etc. can exhibit the same effect as mentioned above.

Fourth Embodiment

Figure 5:
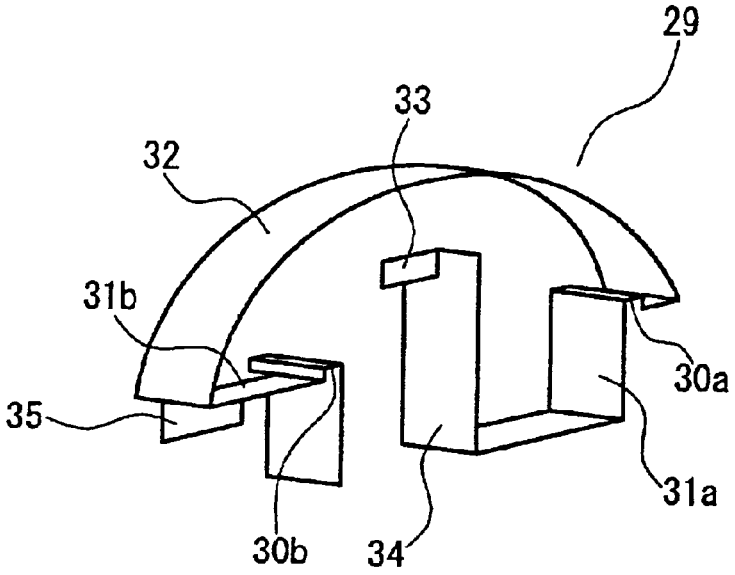
FIG. 5 is a perspective view showing a support used for a metal halide lamp according to a fourth embodiment of the present invention.

Next, as shown in FIG. 5, the metal halide lamp having a rated power of 150 W according to the fourth embodiment of the present invention has the same configuration as in the metal halide lamp having a rated power of 150 W according to the first embodiment except that sleeve holding portions 31*a* and 31*b* are provided with concave grooves 30*a* and 30*b* having a width of 1.3 mm and a depth of 2 mm. To the grooves, the end of the sleeves positioned on the side of the closed portion 1*a* (not shown in FIG. 5) of the outer tube 1 (not shown in FIG. 5) are fitted.

In FIG. 5, reference numeral 32 denotes a column portion; 33 denotes a feeding body connection portion; 34 denotes an elastic body and 35 denotes a power supply wire connection portion, respectively.

According to the configuration of the fourth embodiment of the present invention mentioned above, it is possible to suppress the occurrence of abnormal noises when the lamp is turned on or off, with the sleeve supported firmly, and to realize the high efficiency and the long lifetime of lamp. In addition, since the ends of the sleeves 4 are fitted into the grooves 30*a* and 30*b*, the sleeve 4 can be supported more firmly and prevented from being displaced.

Fourth Embodiment

Figure 6:
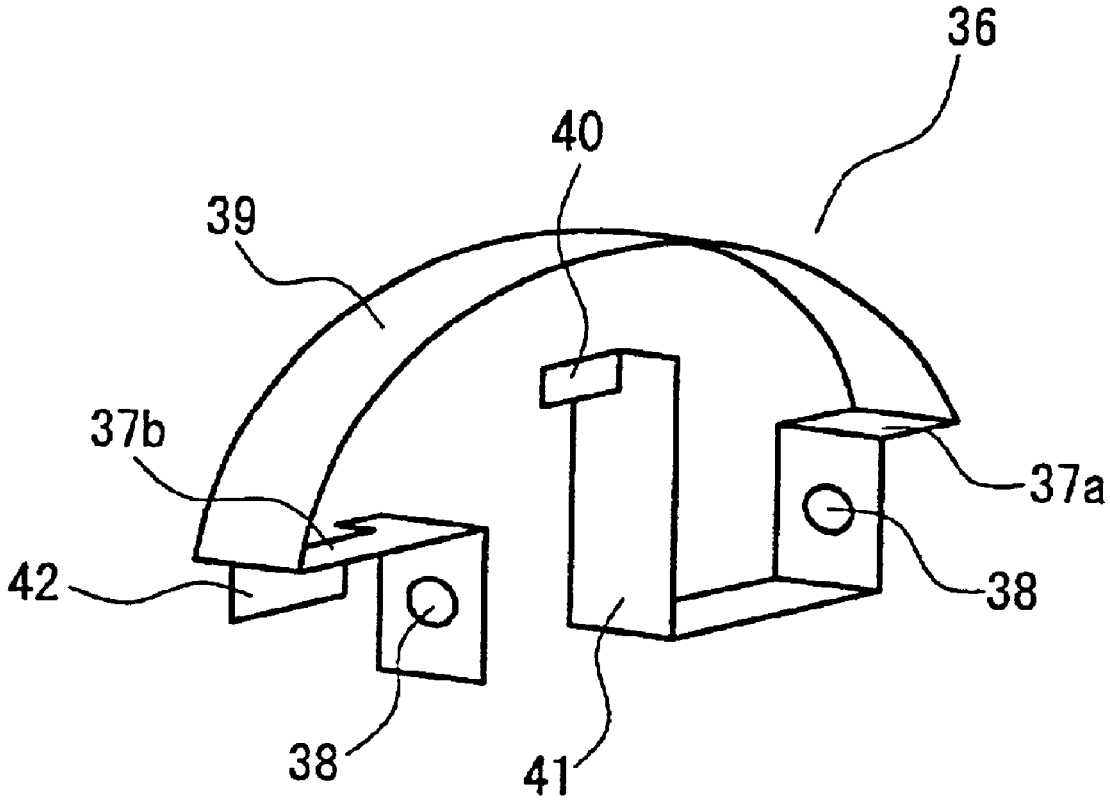
FIG. 6 is a perspective view showing a support used for a metal halide lamp according to a fifth embodiment of the present invention.

Next, as shown in FIG. 6, the metal halide lamp having a rated power of 150 W according to the sixth embodiment of the present invention has the same configuration as in the metal halide lamp having a rated power of 150 W according to the first embodiment except that a convex portion 38 that is in point-contact with the inner surface of the sleeve (not shown in FIG. 6) is provided on the sleeve holding portions 37*a* and 37*b* in the support 36. The convex portion 38 has a diameter of 2 mm and a height of 0.5 mm.

The convex portion 38 is formed by denting one surface, thereby allowing another surface to have a convex shape.

In FIG. 6, reference numeral 39 denotes a column portion; 40 denotes a power supply wire connection portion; and 41 denotes an elastic body, respectively.

According to the configuration of the fifth embodiment of the present invention mentioned above, it is possible to suppress the occurrence of abnormal noises when the lamp is turned on or off, with the sleeve supported firmly, and to realize the high efficiency and the long lifetime of lamp. In addition, since the convex portion 38 is in point-contact with the inner surface of the sleeve, that is, the convex portion 38 is pressed into contact with the inner surface of the sleeve 4, the sleeve 4 can be supported more firmly and can be prevented from being displaced.

Sixth Embodiment

Figure 7:
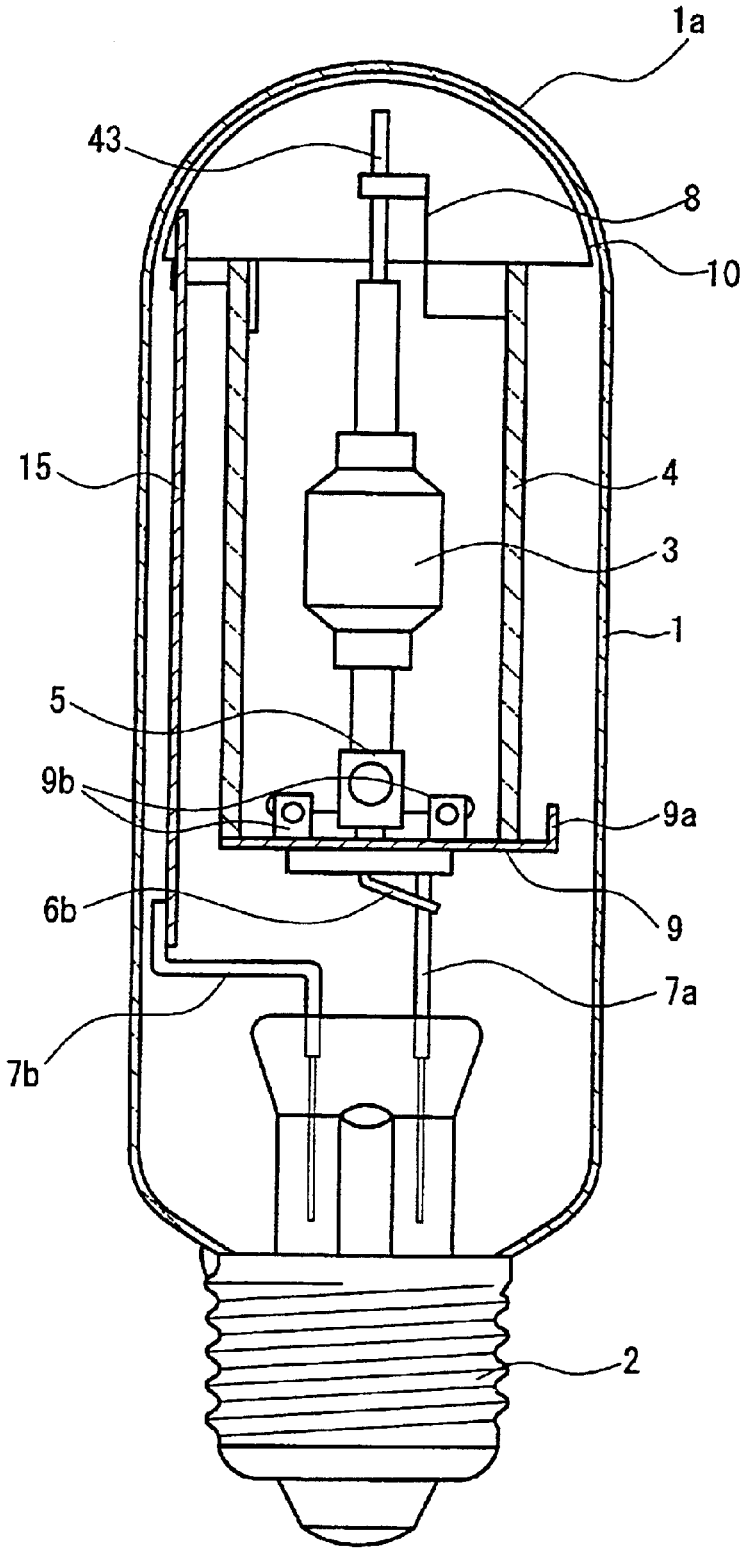
FIG. 7 is a partially cutaway view of a metal halide lamp according to a sixth embodiment of the present invention.

Next, as shown in FIG. 7, the metal halide lamp having a rated power of 150 W according to the sixth embodiment of the present invention has the same configuration as in the metal halide lamp having a rated power of 150 W according to the first embodiment except that a feeding body 43, which is led from the discharge tube 3 to the closed portion 1*a* side, extends to the closed portion 1*a* and the end of the feeding body 43 is sandwiched between the outer tube 1 and the column portion 10 of the support 8.

The column portion 10 is provided with a through hole (not shown in figure) for allowing the extending feeding body 43 to pass through. The end of the feeding body 43 is folded substantially at right angle at the place where the through hole is finished.

According to the configuration of the sixth embodiment of the present invention, it is possible to suppress the occurrence of abnormal noises after the lamp is turned on or off while firmly supporting the sleeve 4, and to realize the high efficiency and long lifetime of lamp. Since the end of the feeding body 43 is sandwiched between the outer portion 1 and the column portion of the support 8, the discharge tube 3 can be fixed firmly and prevented from being displaced.

Moreover, in the sixth embodiment mentioned above, an example in which the through hole for allowing the feeding body 43 to pass through the column portion was explained. However, instead of the through hole, a cutaway portion, etc. may be provided on the column portion 10.

Seventh Embodiment

Figure 8:
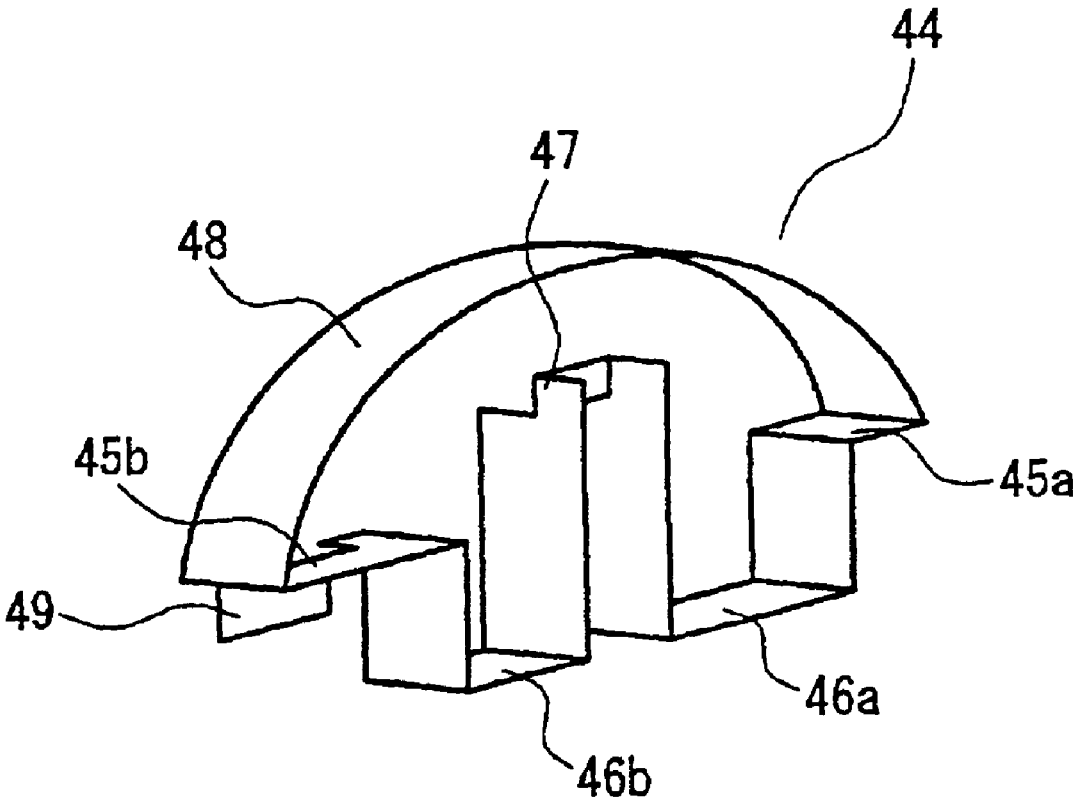
FIG. 8 is a perspective view showing a support used for a metal halide lamp according to a seventh embodiment of the present invention.

Next, as shown in FIG. 8, the metal halide lamp having a rated power of 150 W according to the seventh embodiment of the present invention has the same configuration as in the metal halide lamp having a rated power of 150 W according to the first embodiment except that elastic bodies 46*a* and 46*b* are provided at the ends of the sleeve holding portions 45*a* and 45*b* having the same configuration as the sleeve holding portions 11*a* and 11*b*, and furthermore, a feeding body connection portion 47 connecting to the feeding body 6*a* (not shown in FIG. 8) is disposed between the elastic bodies 46*a* and 46*b*, that is, the both ends of the support 44 are connected to each other.

The elastic bodies 46*a* and 46*b* have an L-shaped cross section in which a portion having a length of 7 mm and a width of 5 mm is connected substantially perpendicular to a portion having a length of 5 mm and a width of 5 mm.

The feeding body connection portion 47 is formed of a plate (size: 2 mm×8 mm).

In FIG. 8, reference numeral 48 denotes a column portion and 49 denotes a power supply wire connection portion, respectively.

According to the configuration of the seventh embodiment of the present invention mentioned above, it is possible to suppress the occurrence of abnormal noises after the lamp is turned on or off, while firmly supporting the sleeve 4, and to realize the efficiency and long lifetime of lamp. In addition, the mechanical strength of the support 44 can be improved more and the discharge tube 3 and the sleeve 4 can be supported more firmly.

Moreover, in each of the embodiments, an example in which the column portions 10, 17, 27, 32, 39 and 48 of the supports 8, 16, 23, 29, 36 and 44 are narrow plates. The same effect can be obtained when a stick column portion is used.

Furthermore, in the above-mentioned embodiment, the case where the translucent ceramic discharge tube 3 is used was explained. However, the same effect can be obtained when a quartz discharge tube is used.

Furthermore, in the above-mentioned embodiments, a metal halide lamp having a rated power of 150 W was explained as an example. However, in the present invention, a metal halide lamp having rated power of 75 to 200 W may be applied.

As mentioned above, according to the embodiments of the present invention, it is possible to provide a highly efficient and long lifetime metal vapor discharge lamp capable of suppressing the occurrence of the abnormal noise after the lamp is on or off with the sleeve 4 supported firmly.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A metal vapor discharge lamp comprising:

an outer tube having a closed portion at a first end and a base at a second end;

a discharge tube inside of which an electrode is provided, located in the outer tube; and a sleeve enveloping the discharge tube and located in the outer tube, wherein;

the sleeve comprises an open portion on the closed portion side of the outer tube, the closed portion side of the outer tube is provided with a support for supporting an end of the closed portion side of the sleeve, the support comprises a column portion having a narrow plate shape or a narrow stick shape separated from the open portion of the closed portion side of the sleeve, and a sleeve holding portion provided at an end of the column portion and is in contact with the sleeve, the support is connected to a feeding body connected to the electrode and led from the discharge tube toward the side of the closed portion, and connected to an electric power supply wire extending toward the side of the base, the column portion and the sleeve holding portion are formed of one continuous member, and the following relationship is satisfied:

$$0.05R \leqq W \leqq 0.25R$$

wherein W (mm) denotes a width of the column portion having the narrow plate shape and R (mm) denotes a maximum outer diameter of the outer tube.

2. The metal vapor discharge lamp according to claim 1, wherein the column portion is provided in the vicinity of the closed portion of the outer tube.

3. The metal vapor discharge lamp according to claim 1, wherein the column portion has a shape along the internal shape of the closed portion of the outer tube.

4. The metal vapor discharge lamp according to claim 1, wherein the support is provided with a protruding portion that is provided in the vicinity of the closed portion of the outer tube and protrudes from the column portion.

5. The metal vapor discharge lamp according to claim 1, wherein the sleeve holding portion has an L-shaped cross section.

6. The metal vapor discharge lamp according to claim 1, wherein the sleeve holding portion is provided with concave grooves into which the end of the sleeve is fitted.

7. The metal vapor discharge lamp according to claim 1, wherein an elastic body is disposed between the sleeve holding portion and the feeding body.

8. The metal vapor discharge lamp according to claim 1, wherein the sleeve holding portion is provided with a convex portion that is brought into point-contact with the sleeve.

9. The metal vapor discharge lamp according to claim 1, wherein the feeding body, which is led from the discharge tube toward the side of the closed portion, extends to the closed portion and is sandwiched between the outer tube and the column portion of the support.

10. The metal vapor discharge lamp according to claim 1, wherein the outer tube is filled with an inert gas.

11. The metal vapor discharge lamp according to claim 10, wherein the inert gas is filled to a pressure of 1.33×104 Pa or more.

12. The metal vapor discharge lamp according to claim 1, wherein the discharge tube and the sleeve are arranged so that each of the central axis of the discharge tube and the central axis of the sleeve substantially corresponds to the central axis of the outer tube.

13. The metal vapor discharge lamp according to claim 1, wherein the discharge tube comprises a light-emitting portion in which an electrode is provided and a light-emitting metal and a rare gas are filled inside; and a thin tube portion which is provided at both ends of the discharge tube and in which a feeding body connected to the electrode is sealed with a sealing material inside the thin tube.

14. The metal vapor discharge lamp according to claim 13, wherein the light-emitting metal is a metal halide.

15. The metal vapor discharge lamp according to claim 1, wherein the feeding body is a conductive cermet obtained by sintering a mixture of molybdenum and alumina, or a metal body selected from the group consisting of niobium and molybdenum.

16. The metal vapor discharge lamp according to claim 13, wherein an end led from the discharge tube of one of the feeding bodies is connected to the support by welding.

17. The metal vapor discharge lamp according to claim 13, wherein an end led from the discharge tube of another of the feeding bodies is connected to the base via a metal wire.

18. The metal vapor discharge lamp according to claim 1, wherein the distance between the closed portion of the outer tube and the column portion is maintained at 3 mm or less.

* * * * *